United States Patent [19]

Goudeau

[11] Patent Number: 4,852,307

[45] Date of Patent: Aug. 1, 1989

[54] SYSTEM FOR RETRIEVING SANDBLASTED CUTTINGS

[76] Inventor: James L. Goudeau, 450 Vitrano La., Independence, La. 70443

[21] Appl. No.: 208,690

[22] Filed: Jun. 20, 1988

[51] Int. Cl.[4] ..... B24C 1/00; B24C 5/00

[52] U.S. Cl. ..... 51/319; 51/270; 51/424

[58] Field of Search ..... 51/270, 273, 317, 319, 51/320, 321, 410, 424, 426; 182/138, 139, 140

[56] References Cited

U.S. PATENT DOCUMENTS

| | | | |
|---|---|---|---|
| 1,773,374 | 8/1930 | Ruemelin | 51/426 X |
| 1,883,918 | 10/1932 | Hall | 51/426 X |
| 3,583,821 | 6/1971 | Shaub | 51/270 X |
| 3,734,496 | 5/1973 | Rubin | 182/139 X |
| 4,214,317 | 7/1980 | Kelly, Sr. | 51/270 X |
| 4,773,189 | 9/1988 | MacMillan et al. | 51/410 X |

*Primary Examiner*—Robert P. Olszewski

*Attorney, Agent, or Firm*—Pravel, Gambrell, Hewitt, Kimball & Krieger

[57] ABSTRACT

An inflatable collection basket, tethered from a bridge superstructure, and including an airline leading thereto. Upon introduction of air into the deflated mechanism, the basket inflates to define a four sided cone having an upper inflated wall portion, descending to a centrally located port, wherein a recovery line leads into for retrieval of the waste and cuttings. There is further included a plurality of inflatable "fingers" extending from each of the corners of the upper border of the cone down to the lower ring, for defining the rectangular cone wherein the cuttings would flow. The cone further includes a material layer around its interior, for serving to confine any cuttings which fall into the cone and flow the cuttings down into the retrieval line. Upon inflation of the cone border and the plurality of fingers, the cone, would be elevated to a position adjacent the superstructure to be sandblasted, and the upper border of the cone would be secured to the superstructure via a plurality of lines or the like therefore securing the upper border of the cone against the superstructure. In other embodiments, the cone may be rectangular shaped or include a pair of cones, to cover a broad area. The retrieval line would be attached to a vacuum pump or the like so that any of the materials falling into the retrieval cone would immediately be suctioned out of the cone through the line and into a retrieval tank or truck located away from the blasting site.

6 Claims, 4 Drawing Sheets

SYSTEM FOR RETRIEVING SANDBLASTED CUTTINGS

BACKGROUND OF THE INVENTION

1. Field of the Invention

The present invention relates to sandblasting. More particularly, the present invention relates to a system for collecting the cuttings from the sandblasting process into a container in order to eliminate the accumulation of the cuttings in the surrounding atmosphere.

2. General Background

In the field of wet or dry sandblasting, whereby the paint coatings sandblasted from a steel superstructure such as a bridge, or tanks or the like, the most significant problem is the accumulation of the materials that are sandblasted from the item and the flow of the sand itself into the ambient atmosphere, thus causing unwanted pollution. More and more, the government is restricting the type of process that may be utilized in stripping paint from a bridge or the like, due to this problem. Therefore, there is a significant need for a system whereby these cuttings can be entrapped, collected, and transported to an off-site area without the cuttings having the opportunity to flow or to move into the atmosphere and possibly contaminate the surrounding area, to include water ways and ground water.

In the present state of the art, the most common yet failed attempt at this process is to drape extensive tarpaulin or the like from the bridge superstructure down to the ground, in the hope that the cuttings will be confined within a certain area, whereby the cuttings and the sand can be vacuumed or retrieved in some other manner. However, this system falls short due to the fact that the manner of draping creates large gaps between the drapes, or due to the wind or rain, the drapes are maneuvered in such a manner that the cuttings have an opportunity to escape the confined area, and cause contamination.

SUMMARY OF THE PRESENT INVENTION

The present invention relates to a system for retrieving, collecting and disposing of sandblasting waste materials and cuttings in a simple and straightforward manner. What is provided is an inflatable collection basket, tethered from a bridge superstructure, and including an airline leading thereto. Upon introduction of air into the deflated mechanism, the basket inflates to define a four sided cone having an upper inflated wall portion, descending to a centrally located port, wherein a recovery line leads into for retrieval of the waste and cuttings. There is further included a plurality of inflatable "fingers" extending from each of the corners of the upper border of the cone down to the lower ring, for defining the rectangular cone wherein the cuttings would flow. The cone further includes a material layer around its interior, for serving to confine any cuttings which fall into the cone and flow the cuttings down into the retrieval line. Upon inflation of the cone border and the plurality of fingers, the cone, would be elevated to a position adjacent the superstructure to be sandblasted, and the upper border of the cone would be secured to the superstructure via a plurality of lines or the like therefore securing the upper border of the cone against the superstructure. In other embodiments, the cone may be rectangular shaped or include a pair of cones, to cover a broad area. The retrieval line would be attached to a vacuum pump or the like so that any of the materials falling into the retrieval cone would immediately be suctioned out of the cone through the line and into a retrieval tank or truck located away from the blasting site.

In an additional embodiment, there may be provided a means for shrouding a water tank or the like so that any sandblasting done on the tank may be done within the confines of the shroud. This means would include a plurality of members attachable to the exterior skin of the tank, for securing a framework a distance above the tank so that when shrouded, there is provided space between the shroud and the tank skin to allow workman to undertake sandblasting within the shroud.

Therefore, it is the principal object of the present invention to provide an inflatable retrieval system for retrieving and collecting cuttings and sand waste from a bridge superstructure or the like during the sandblasting process.

It a further principal object of the present invention to provide a cone for collecting sandblasting waste, which is positioned beneath the superstructure in a deflated state, and upon inflation, inflates into a cone wherein cuttings falling into the cone may be retrieved therefrom.

It is still a further object of the present invention to provide a collection system for sandblasting waste which is easy to position in place, and may be readily secured to the underside of a structure such as a bridge superstructure to be sandblasted.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 3 represents the item in FIG. 2 tethered to a bridge superstructure or the like;

FIG. 5 illustrates the side view of the collection cone secured to the superstructure of a bridge or the like;

DETAILED DESCRIPTION OF THE PREFERRED EMBODIMENT

FIGS. 1–13 illustrate the preferred embodiment of the apparatus of the present invention by the numeral 10.

Figure 1:
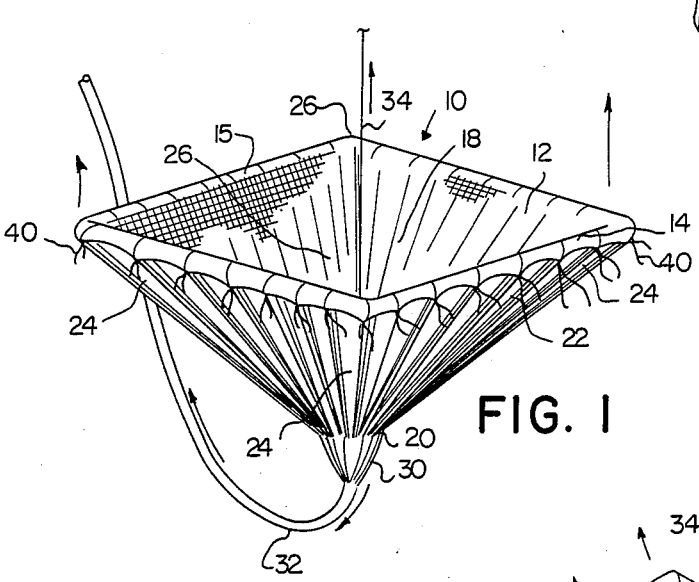
FIG. 1 illustrates the preferred embodiment of the apparatus of the present invention in the inflated state.

As seen in the FIGURES, in particular FIG. 1, apparatus 10 is illustrated in the inflated state, and in position to be utilized as a collection means during the sandblasting process. Apparatus 10 comprises a four-walled cone type structure 12 having an upper rectangular perimeter 14 which is inflatable through line 16 (see FIG. 2), so that air is introduced into perimeter 14, the inflation of the outer ring defines an upper support perimeter 15 whereby the remainder of the cone structure extends downward therefrom. As further illustrated, apparatus 10 further comprises a fabric wall 18, attached at its uppermost portion to perimeter 15, and sloping downward to a common cone bottom 20, which may be a ring or the like structure at the fabric is connected thereto. In order to strengthen fabric 18, there may be included a plurality of fabric ribs 22 extending from the upper perimeter 15 downward to the ring 20 as seen in FIG. 1. Additionally, so that cone 10 may be fully extended during operation, the cone further includes a plurality of inflatable fingers 24 which extend from each of the corners 26 of the upper border 15 downward to the ring 20, so that in the preferred embodiment following the inflation of border 15, air would then extend downward into each inflatable finger 24 at each corner to fully extend the fabric 18 between the upper border 15 and the lower ring 20 for defining the collection space 26 within the confines of the border 15 along the inner surface of the fabric walls 18.

Following its attachment to ring 20, the fabric 18 forms a lower retrieval bend 30, which interconnects with a suction line 32 which is connected to a remote suction pump (not illustrated), for suctioning any debris which would be falling into cone 10, from the sandblasting process, as will be discussed further.

Figure 3:
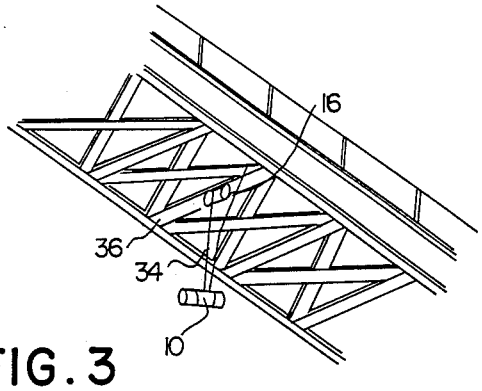

As seen in FIGS. 1 and 3 the apparatus 10 would be tethered through tether line 34 from the superstructure 36 of a bridge (FIG. 3), with the tether line being a rather substantial steel cable for supporting the weight of the cone during the sandblasting process.

Figure 4:
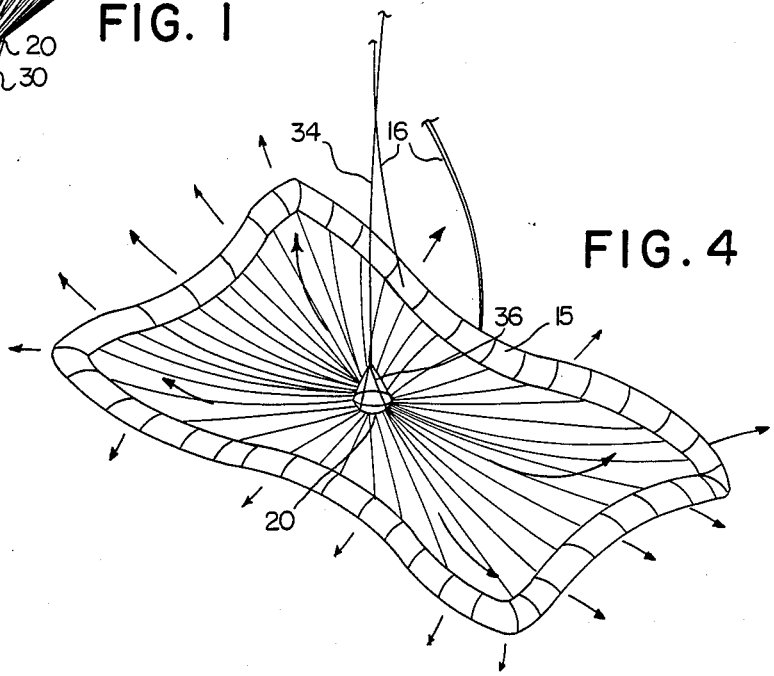
FIG. 4 illustrates the retrievable undergoing inflation.

As seen in FIG. 4 tether line 34 would attach to a plurality of shorter lines 36 which would be engaged to ring 20, to fully support the cone during the process.

Figure 5:
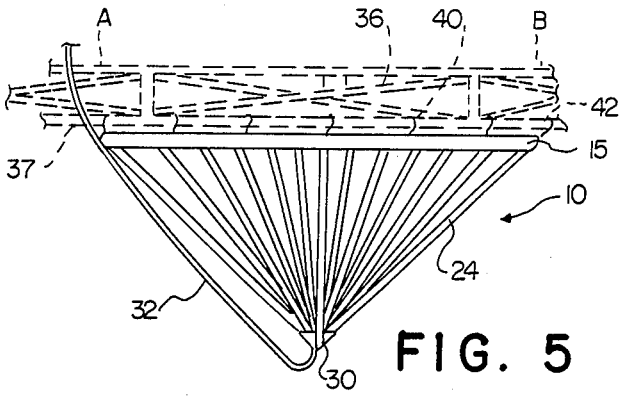
Figure 6:
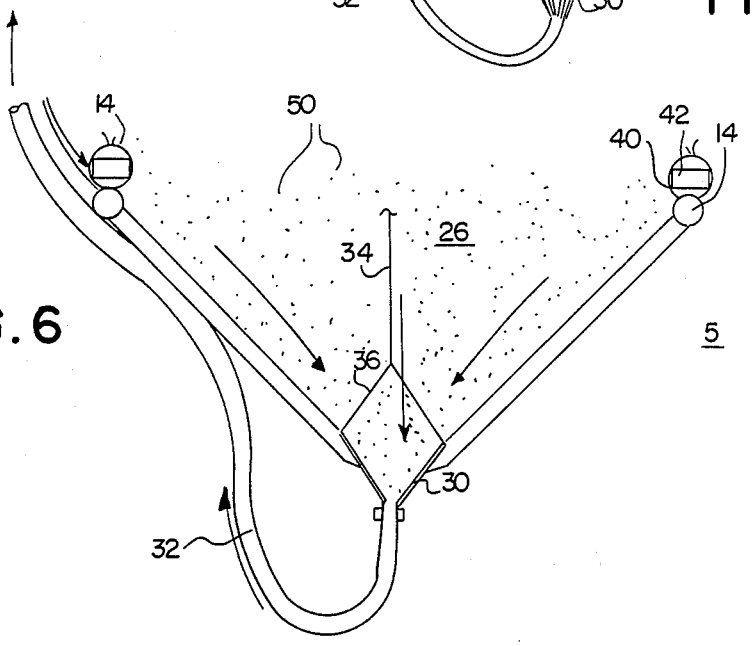
FIG. 6 represents and additional embodiment of the collection cone of the present system.

Turning now to FIGS. 5 and 6, in FIG. 5 there is illustrated he apparatus 10 in position, fully with the border 15 and finger 24 fully inflated, and supported against the superstructure 36 of a bridge in an area adjacent the lower surface 37 so that when sandblasting would occur in the area between lines A and B as seen in FIG. 5, any debris from the sandblasting would fall into the confines of the collection zone 26 (see FIG. 6) and be suctioned through the lower funnel portion 30 into suction line 32 for retrieval at the remote source. The manner in which the cone apparatus 10 is secured to the superstructure 36 involves a plurality of attachment lines 40 (see FIGS. 1 and 5) which would engage around the lower beam 42 on the superstructure 36, so that the apparatus 10 is supported adjacent the beam in order to eliminate any inadvertent escape of materials as it falls between the beam and the apparatus.

Figure 2:
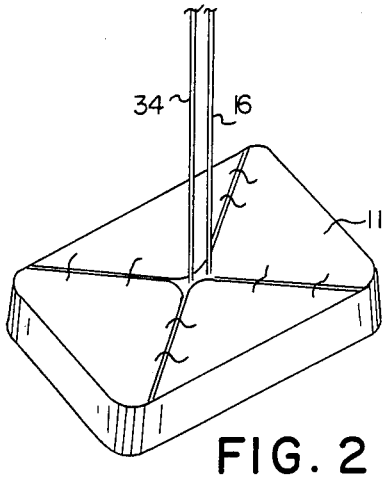
FIG. 2 represents the preferred embodiment of the system of the present invention in the deflated and package state.

Turning now to the process by which apparatus 10 is placed in position and inflated, reference is made to FIGS. 2, 3 and 4. As was stated earlier in FIG. 3 there is illustrated the apparatus 10 in a deflated and packaged state tethered from line 34 from the superstructure 36 of a bridge or the like, with airline 16 leading thereto. The apparatus would be supported a predetermined distance from line 34 so that proper inflation may take place. As seen in FIG. 2, apparatus 10 would be preferably confined within a package 11 which would be easily opened after air has been introduced into the apparatus via airline 16. Upon the introduction of air through line 16, the air line would introduce air into the upper border 15 as seen in FIG. 4, with the upper border 15 expanding outwardly in the configuration of a square or rectangle as seen in FIG. 4. Also, the apparatus hanging from line 34 is secured via the plurality of lines 36 to ring 20 at the bottom of the cone. Upon the full inflation of border 15 as seen in FIG. 4, air would then begin to move into the plurality of fingers 24, and would ultimately cause the upper border 15 to be supported upward away from ring 20, the full distance of the extent of the fabric 18, to form the cone apparatus 10 as seen in FIG. 1, in he fully inflated state. Following its full inflation, apparatus 10 would then be reeled upwardly towards the superstructure so that it is adjacent to it as seen in FIG. 5 wherein it would be fully attached via the plurality of lines 40. Following its attachment, the suction line 32 would therefore be activated, and the sandblasting could begin, with all of the materials from the sandblasted particles 50 as seen in FIG. 6, would fall within collection space 26 within cone 10, and would be suctioned through funnel 30 through line 32 and to the remote place. Therefore, it is through this unique system of collection of sandblasting debris, of the present invention relates, and solves the problems as confronted in the art.

Figure 7:
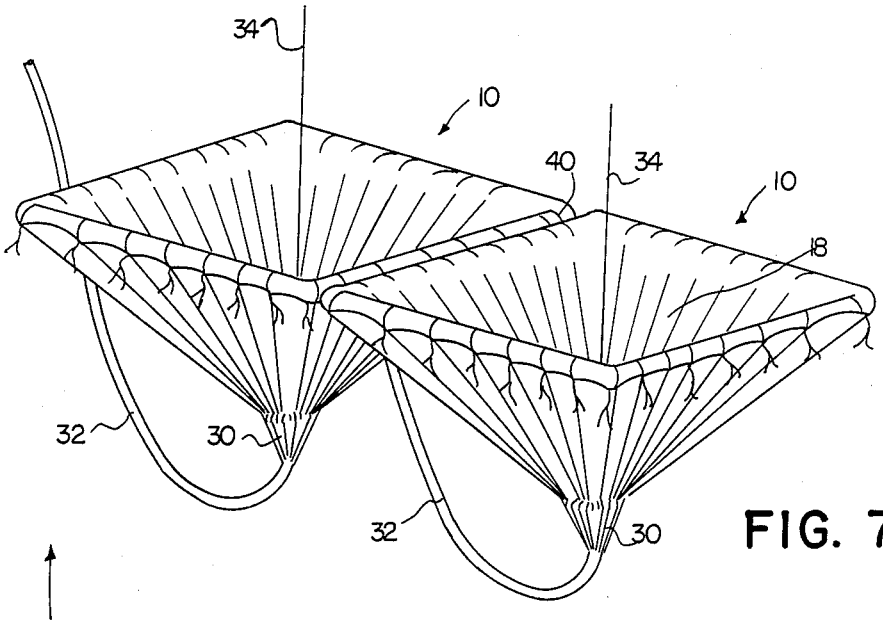
FIG. 7 illustrates a cross-section representational view of the collection cone in position during the collection process.

FIG. 7 represents an additional embodiment of the cone of the apparatus 10 whereby it simply illustrates a pair of the apparatus 10, each of the apparatus 10 including the same components as one apparatus, yet the two secured together via for example lines 40, to form a larger area which could be sandblasted at one time. In addition, there may be an embodiment where the apparatus would form a single cone but be in a rectangular configuration as seen in FIG. 7 but as a single rectangular cone, to achieve a greater area yet have a single point where the collection would take place.

In this particular embodiment, it is foreseen that the apparatus in addition to serving as a means for catching the sandblasting cuttings, also could serve as a safety net for workers during the sandblasting process. Although the sidewalls may be of material strong enough to stop the fall of a worker, it is foreseen that if it could be used as a safety net solely, that the sidewalls may have to be strengthened in order to properly serve this purpose.

Figure 8:
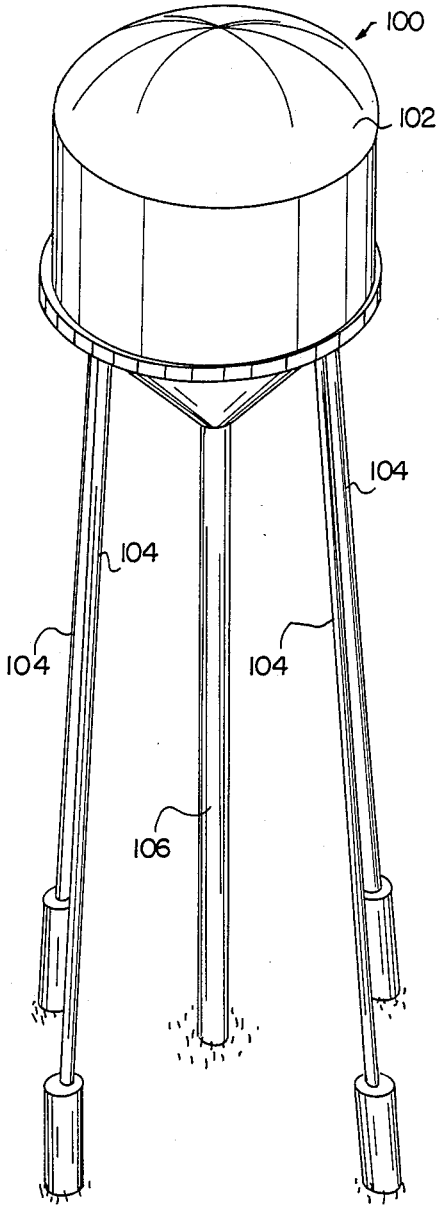
FIG. 8 illustrates an overall view of a water tower for use with the present invention.

FIGS. 8–13 illustrate an embodiment of the apparatus in the form of a shroud which would be utilized in conjunction with the sandblasting of a water tower or the like. As seen in FIG. 8, there is illustrated a water tower 100 comprising an upper container portion 102 supported by a plurality of legs 104 and having a central water inlet pipe 106. The tower is of the type that is found in most municipalities and must be continuously repainted in order to withstand the elements during use.

Figure 9:
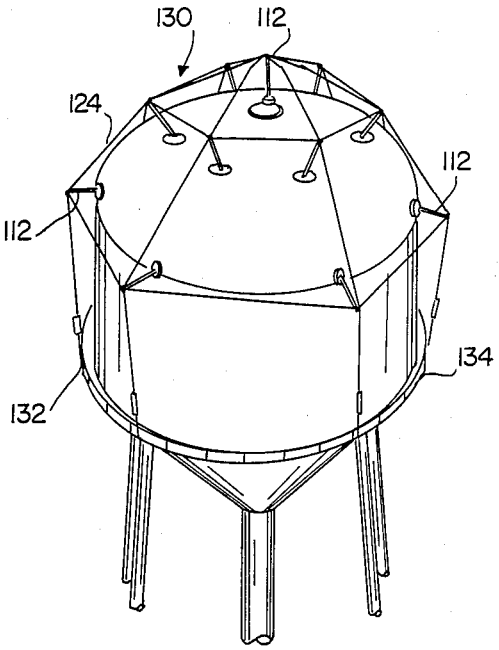
FIG. 9 represents the framework extending over the water tower tank in the additional embodiment of the present invention.
Figure 10:
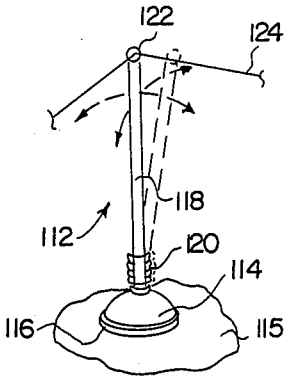
FIG. 10 represents an isolated view of an upright member for use in an additional embodiment of the apparatus of the present invention.
Figure 11:
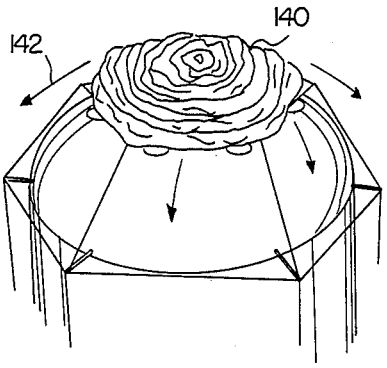
FIGS. 11, 12, and 13 represent views of the water tower in the process of being shrouded over for sandblasting in the additional embodiment of the system of the present invention.
Figure 12:
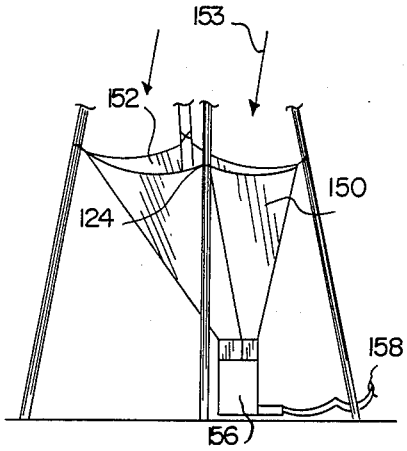
Figure 13:
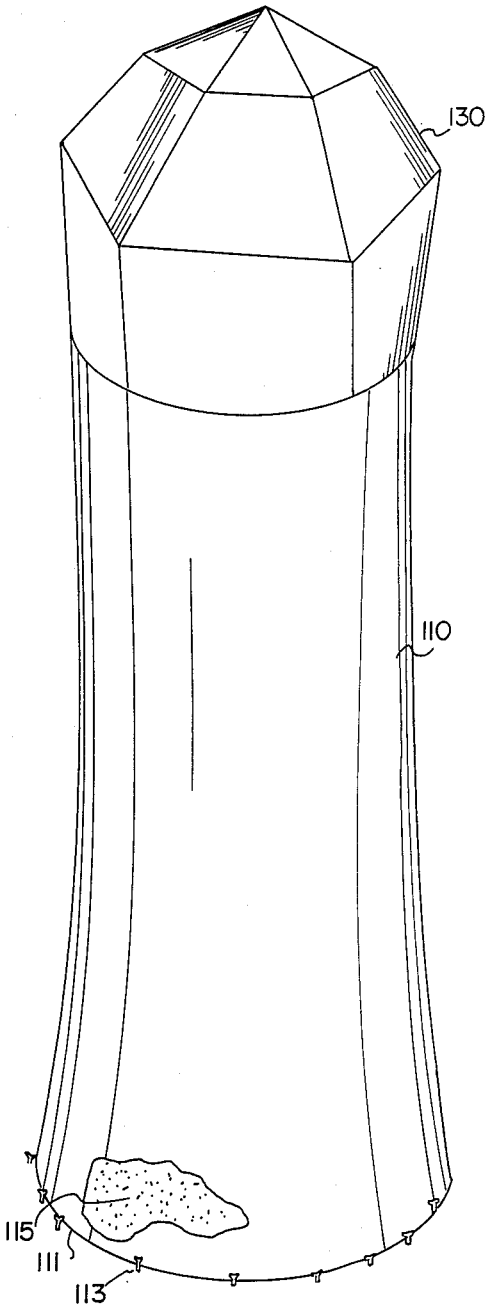

FIG. 9–13 illustrate the manner in which water tower 100 would be shrouded in a shroud 110 (see FIG. 13), prior to sandblasting. The method would involve a plurality of support members 112 (as seen in isolated view in FIG. 10) each support member having a base portion 114 which would be engaged to the surface 115 of the tower tank 102 via a suction cup or the like 116 with the member having an upper extended arm portion 118 flexibly engaged via a spring member 120 to base 114, so that the member may move flexibly as seen in FIG. 110 in phantom view. Further, each member 112 includes an upper ring 122 for allowing a line 124 strung between the members 112 to form a framework 130 as seen in FIG. 9. The framework 130 would involve a plurality of the members 112 placed at strategic locations around the tank 102, with the line 124 strung between the members through the rings 122 and anchored at points 132 along the base perimeter 134 of tank number 102, so that when the lines 124 are taut, the framework 130 is formed. Following the formation of framework 130 as seen in FIG. 9, a flexible shroud 140 is positioned atop the uppermost member 112, (FIG. 11) and allowed to slide downward in the direction of arrows 142 so that the entire framework 130 is shrouded by shroud 110 as seen in FIG. 13. Therefore, the framework 130 supported on each member 112 a distance away from surface 115 of tank 102 provides a work space for the worker to move along the tank 102 and do the necessary sandblasting, yet since tank 102 is shrouded in shroud 110 any of the debris or the like which would be the result of the sandblasting would be maintained within shroud 110, the bottom of which is anchored around its circumferential lowermost end portion 111 via anchors 113, as seen in FIG. 13. Of course, for the safety and health of the workers, an air line or the like could be introduced into the shroud in order to provide a continuous flow of fresh air for the workers as the work progresses.

In FIG. 12 there is illustrated an additional item which may be placed within the four posts 104 of tank 102, which comprises an inverted truncated funnel 150, having an open end 152 in which the debris from the sandblasting of tank 102 would fall in the direction of arrows 153 into the container portion 124 of inverted funnel 150, and would eventually be contained within a lower container portion 156, and may be siphoned through line 158 out to a container truck or the like rather than the debris simply settle on the ground as seen in cutaway view in FIG. 13 as item 115, most of the debris could be trapped within inverted funnel 150, and vacuumed off. This would be an alternative method of housing the debris.

It is also foreseen that in place of using the members in order to maintain the shroud a distance apart from the skin of the tank, that due to problems that may be with wind or the like, it is foreseen that an air source can be pumped into the shroud in order to inflate the shroud and maintain it a distance apart between the skin of the tank and the shroud through a layer of air. Therefore, in place of the members the air pressure inflating the shroud around the tank would be utilized in that manner.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for trapping cuttings during sandblasting of a structure, comprising the following steps:

(a) providing an inflatable collection bin;

(b) suspending the inflatable collection bin in the deflated state from the structure to be sandblasted;

(c) introducing air or the like into the inflatable bin, imparting expansion of the inflatable bin from the deflated state to a cone shape state, the mouth of the cone positioned adjacent the structure being sandblasted for receiving cuttings sandblasted therefrom;

(e) attaching a retrieval line to the lower portion of the cone, so that any cuttings falling into the cone would likewise be retrieved in the retrieval line; and (f) transporting the cuttings through the retrieval line by vacuum into a receiving tank located away from the collecting bin.

2. The method in claim 1, further including the step of inflating wherein the inflation of the cone includes the step of inflating an upper perimeter border of the cone, and a plurality of inflatable fingers extending from the upper portion of the cone to the lower portion of the cone for helping to define the shape of the cone.

3. The method in claim 1, wherein the inflated cone may be raised or lowered in relation to the structure for receiving cuttings thereinto.

4. The method in claim 1, wherein the cone includes impermeable side walls for receiving the cuttings thereinto.

5. The method in claim 1, wherein there may be provided an additional cone adjacent the first cone for defining a larger retrieval space under the structure being sandblasted.

6. An apparatus for receiving cuttings during the sandblasting of a structure, the apparatus comprising:

(a) in the deflated state, a confined package tethered from a line on the structure;

(b) in the inflated state, a cone shape receiving bin, having an air inflated upper perimeter, defining an enlarged mouth portion, and a lower constricted mouth portion, for defining the shape of the cone;

(c) a continuous wall portion within the cone for providing the retrieval of cuttings received in the enlarged mouth portion to be directed into the constricted lower mouth portion; and (d) a retrieval line extending from the bottom of the lower mouth portion for retrieving the cuttings falling into the mouth portion via a vacuum.

* * * * *